US010690322B2

(12) United States Patent
Ko

(10) Patent No.: US 10,690,322 B2
(45) Date of Patent: Jun. 23, 2020

(54) LAMP ASSEMBLY WITH IMPROVED ASSEMBLY CONVENIENCE AND WATERPROOF PERFORMANCE

(71) Applicants: VISION X ASIA CO., LTD., Hwaseong-si (KR); In Hong Ko, Seoul (KR)

(72) Inventor: In Hong Ko, Seoul (KR)

(73) Assignee: VISION X ASIA CO., LTD., Hwaseong-si (KR)

( * ) Notice: Subject to any disclaimer, the term of this patent is extended or adjusted under 35 U.S.C. 154(b) by 0 days.

(21) Appl. No.: 16/281,491

(22) Filed: Feb. 21, 2019

(65) Prior Publication Data

US 2019/0323688 A1 Oct. 24, 2019

(30) Foreign Application Priority Data

Apr. 19, 2018 (KR) ..... 10-2018-0045438

(51) Int. Cl.

| | |
|---|---|
| ***F21V 17/10*** | (2006.01) |
| ***F21S 4/28*** | (2016.01) |
| ***F21V 31/00*** | (2006.01) |
| ***F21V 19/00*** | (2006.01) |
| ***F21V 7/00*** | (2006.01) |

(52) U.S. Cl.

CPC ..... *F21V 17/10* (2013.01); *F21S 4/28* (2016.01); *F21V 7/0083* (2013.01); *F21V 19/003* (2013.01); *F21V 31/00* (2013.01); *F21V 31/005* (2013.01)

(58) Field of Classification Search

CPC ..... F21V 17/108; F21V 17/14; F21V 7/0083

See application file for complete search history.

(56) References Cited

U.S. PATENT DOCUMENTS

2010/0254148 A1 10/2010 Huang et al.
2013/0021796 A1* 1/2013 Dalsgaard ..... F21V 21/30 362/235

(Continued)

FOREIGN PATENT DOCUMENTS

DE 102009015872 10/2009
EP 2384106 11/2011

(Continued)

*Primary Examiner* — Alexander K Garlen
*Assistant Examiner* — Eric T Eide
(74) *Attorney, Agent, or Firm* — Cantor Colburn LLP

(57) ABSTRACT

Provided is a lamp assembly, including: a housing including a bottom portion and side wall portions forming a light source mount portion in a longitudinal direction, a flange portion being connected to each front end of the side wall portions and forming a first insertion portion with an inner side surface thereof being open, and a second insertion portion provided on a bottom surface of the first insertion portion; a lampshade provided therein with a light source, and coupled to the mount portion; a translucent panel slidably coupled to the first insertion portion; a packing fitted in the second insertion portion; and a press bar being inserted in the first insertion portion between an upper surface of the flange portion and the translucent panel and pressing the translucent panel and the packing, thereby fixing the translucent panel and endowing the packing with watertightness.

3 Claims, 6 Drawing Sheets

(56) References Cited

U.S. PATENT DOCUMENTS

| | | | | |
|---|---|---|---|---|
| 2014/0071699 | A1* | 3/2014 | Plomteux | F21K 99/00 362/373 |
| 2017/0130914 | A1* | 5/2017 | Gassauer | F21V 23/0407 |
| 2018/0058679 | A1* | 3/2018 | Majerczyk | F21V 17/12 |
| 2018/0335203 | A1* | 11/2018 | Yu | F21V 23/023 |
| 2019/0162392 | A1* | 5/2019 | Guerra | F21S 8/024 |

FOREIGN PATENT DOCUMENTS

| | | |
|---|---|---|
| JP | 2012033283 | 2/2012 |
| KR | 200273384 | 5/2002 |
| KR | 200347653 | 4/2004 |
| KR | 20150131793 | 11/2015 |

* cited by examiner

LAMP ASSEMBLY WITH IMPROVED ASSEMBLY CONVENIENCE AND WATERPROOF PERFORMANCE

BACKGROUND OF THE INVENTION

Field of the Invention

The present invention relates generally to a lamp assembly with improved assembly convenience and waterproof performance. More particularly, the present invention relates to a lamp assembly, including: a housing including a bottom portion and side wall portions forming a light source mount portion in a longitudinal direction, a flange portion being connected to each front end of the side wall portions and forming a first insertion portion with an inner side surface thereof being open, and a second insertion portion provided on a bottom surface of the first insertion portion; a lampshade provided therein with a light source, and coupled to the mount portion; a translucent panel slidably coupled to the first insertion portion; a packing fitted in the second insertion portion; and a press bar being inserted in the first insertion portion between an upper surface of the flange portion and the translucent panel and pressing the translucent panel and the packing, thereby fixing the translucent panel and endowing the packing with watertightness, and thus, it is possible to improve assemblability and waterproof performance of the translucent panel provided in a lamp, particularly, a bar type lamp.

Description of the Related Art

A conventional lamp is configured such that, with a light source accommodated in a shade-shaped housing, a translucent plate, through which light transmits, is coupled to a front of the housing, thereby protecting the light source inside.

Here, in the case of lamps provided in light towers or construction vehicles installed in various construction sites, due to the characteristics of outdoor use, watertightness between the housing and the translucent plate must be ensured to protect the electrically operated light source.

As in the document of Korean Utility Model Registration No. 20-0273384, in the case of a lamp with a general cylindrical housing, a shape of the translucent plate is also cylindrical, so screw coupling of the housing and translucent plate is possible. Thus, watertightness between the housing and the translucent plate can be secured by simply inserting an O-ring packing at the end portions of the housing and the translucent plate, so it is possible to easily realize waterproof performance of the lamp.

However, in a bar type lamp in which a plurality of light sources are arranged in a line to have a predetermined length, since the housing has a bar shape having a predetermined length, a square plate type translucent panel as the translucent plate must be used. These bar type housing and translucent plate cannot have a screw type coupling structure, but can only be assembled via bolts.

In this case, as the entire length of the lamp becomes longer, the points at which the bolts are coupled are increased, which lowers the assemblability. Moreover, since it is difficult to fix the packing closely fitted between the housing and the translucent panel, waterproof performance may easily be lost during use.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been made keeping in mind the above problems occurring in the related art, and a first object of the present invention is to provide a lamp assembly to facilitate assembly of a housing and a translucent panel of a bar type lamp while maintaining the stable waterproof performance by pressing a packing between the housing and the translucent panel, in which a housing is provided a front end of a side wall portion thereof with a first insertion portion into which a translucent panel is slidably coupled, and a second insertion portion in which a packing is fitted, and a press bar is forcibly fitted between a flange portion and the translucent panel, thereby improving assemblability and waterproof performance by fixing the translucent panel and pressing the packing by pressure of the press bar.

Further, a second object of the present invention is to provide a lamp assembly to facilitate assembly of the press bar while firmly maintaining fixing between the housing and the press bar, in which the housing and the press bar are assembled by an engagement structure using a first stop protrusion of the housing and a first hook protrusion of the press bar.

In addition, a third object of the present invention is to provide a lamp assembly to facilitate mounting of a lampshade while firmly maintaining fixing between the housing and the lampshade, in which mounting of the lampshade is enabled by an engagement structure using a second stop protrusion of the housing and a second hook protrusion of the lampshade.

Furthermore, a fourth object of the present invention is to provide a lamp assembly, in which the lampshade is divided into a body portion and an edge portion to facilitate manufacturing of the lampshade, and assembly of the lampshade is performed by using a third stop protrusion of the body portion and a third hook protrusion of the edge portion to facilitate assembly of the body portion and the edge portion.

In order to achieve the above objects, according to some aspect of the present invention, there is provided a lamp assembly including: a housing including a bottom portion and side wall portions forming a light source mount portion in a longitudinal direction, a flange portion being connected to each front end of the side wall portions and foaming a first insertion portion with an inner side surface thereof being open, and a second insertion portion provided on a bottom surface of the first insertion portion; a lampshade provided therein with a light source, and coupled to the mount portion; a translucent panel slidably coupled to the first insertion portion; a packing fitted in the second insertion portion; and a press bar being inserted in the first insertion portion between an upper surface of the flange portion and the translucent panel and pressing the translucent panel and the packing, thereby fixing the translucent panel and endowing the packing with watertightness.

Further, in the lamp assembly according to the present invention, the housing further includes a first stop protrusion protruding backwards from the flange portion, and the press bar includes a first hook protrusion provided at an outer end thereof to be engaged with the first stop protrusion.

Further, in the lamp assembly according to the present invention, the housing may further include a second stop protrusion protruding from an inner side surface of the side wall portion, and the lampshade may include a second hook protrusion protruding downwardly from a front end of each of opposite outer sides thereof so as to be engaged with the second stop protrusion.

Furthermore, in the lamp assembly according to the present invention, the lampshade may further include: a body portion provided with a receiving hole; and an edge portion coupled to a front end of the body portion, and provided with the second hook protrusion, wherein the body portion includes a third stop protrusion protruding from a front end of an outer side thereof, and the edge portion includes a third hook protrusion protruding from a rear surface thereof to be engaged with the third stop protrusion.

According to the lamp assembly of the present invention, it is advantageous in that in a bar-type lamp which is difficult to adopt a screw-coupling structure, the assembly structure of the housing and translucent panel is simplified, making assembly easy and quick. In addition, since the watertightness of the packing can be stably maintained only by fixing the translucent panel, the assemblability and waterproof performance are improved compared to a conventional bar type lamp.

It is further advantageous in that the housing and the press bar, the housing and the lampshade, and the body portion and the edge portion constituting the lampshade are assembled by hook-to-hook coupling to shorten the manufacturing and assembling time of the lamp parts.

BRIEF DESCRIPTION OF THE DRAWINGS

The above and other objects, features, and other advantages of the present invention will be more clearly understood from the following detailed description when taken in conjunction with the accompanying drawings, in which.

DETAILED DESCRIPTION OF THE INVENTION

Figure 1A:
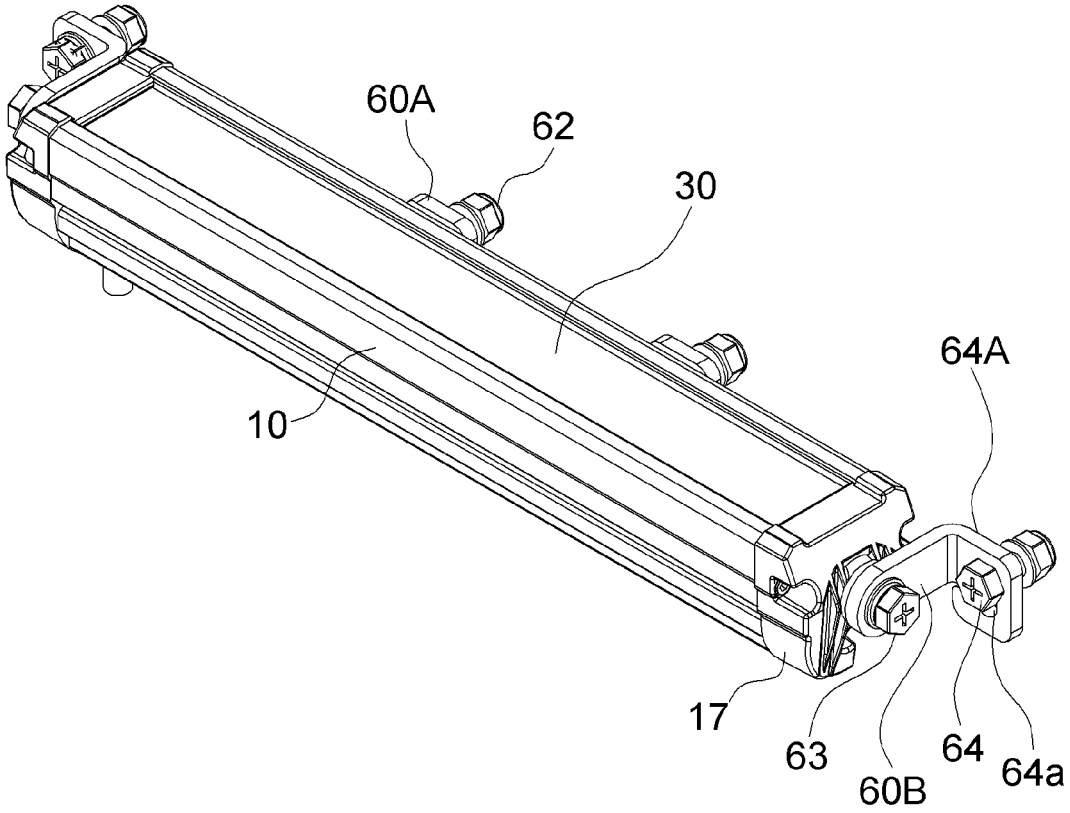
FIGS. 1A and 1B are perspective views of a lamp assembly according to the present invention.
Figure 1B:
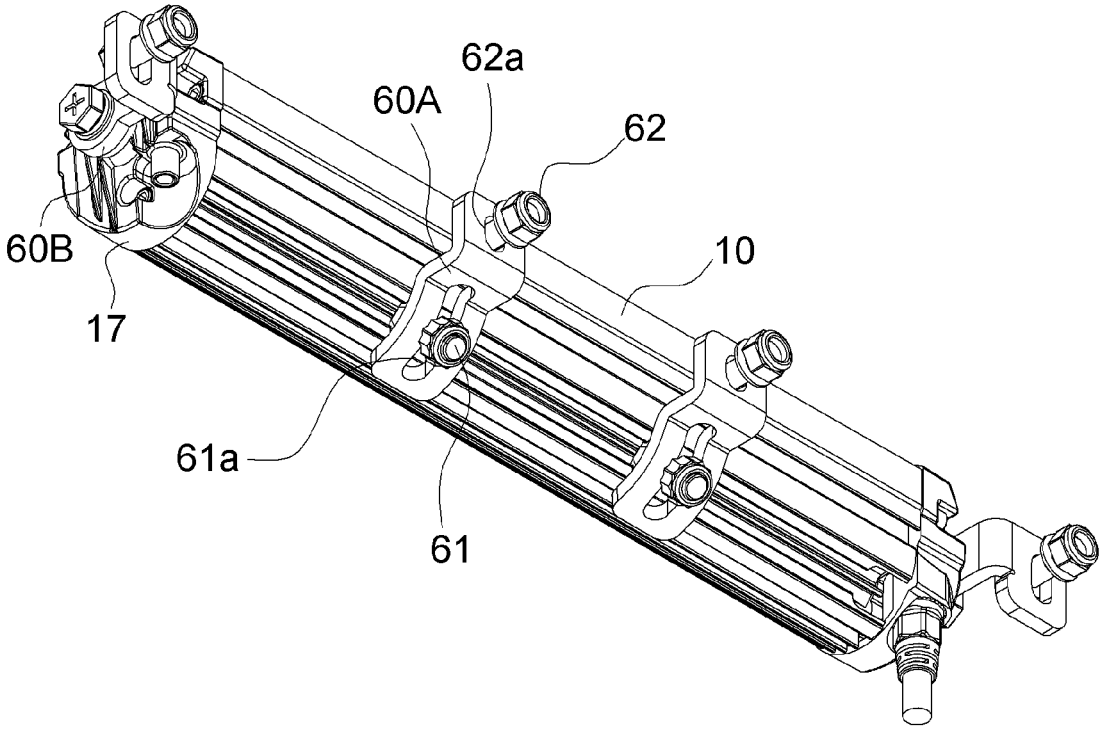
Figure 2:
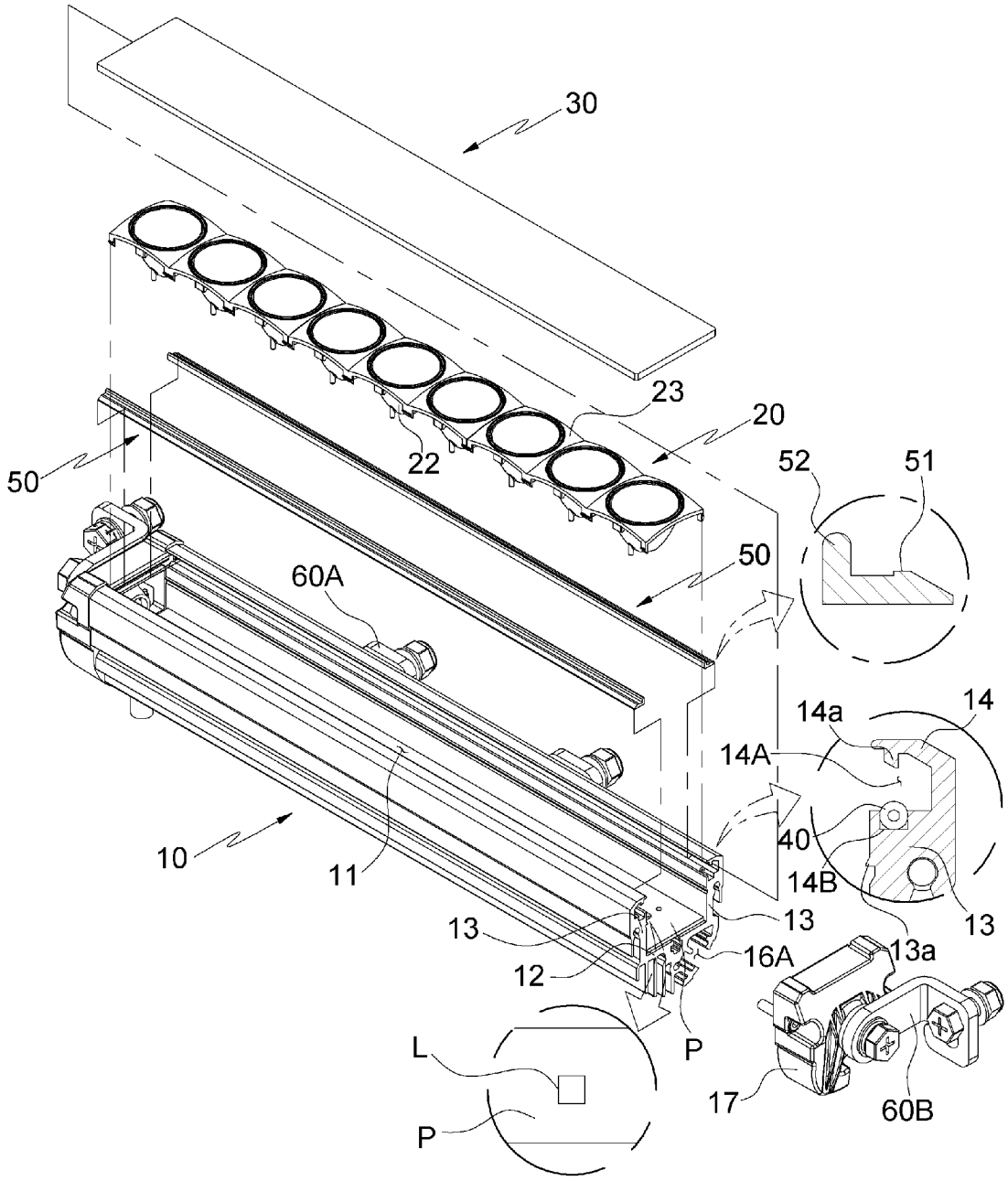
FIGS. 2 and 3 are first exploded perspective views of the lamp assembly according to the present invention.
Figure 3:
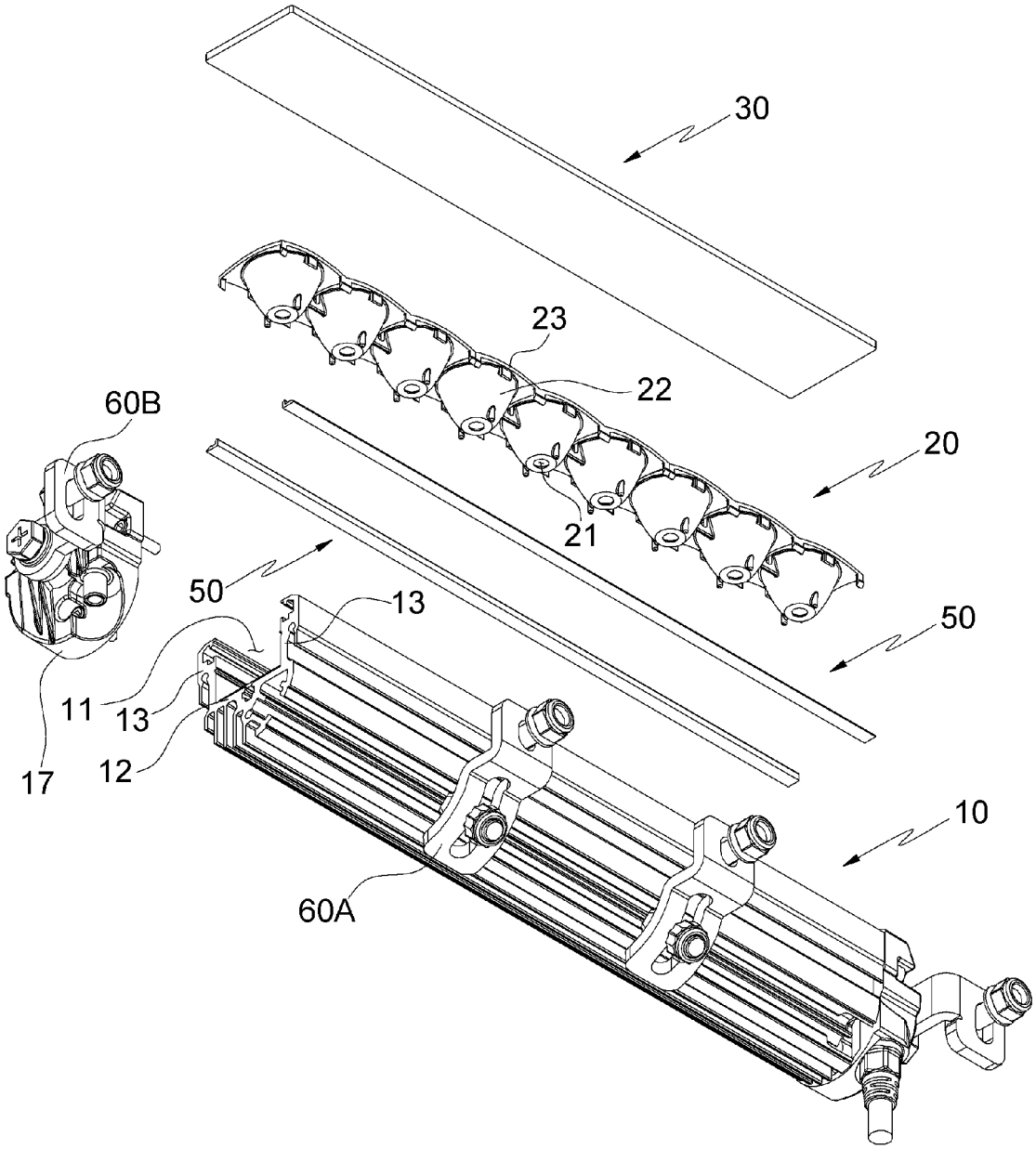
Figure 4:
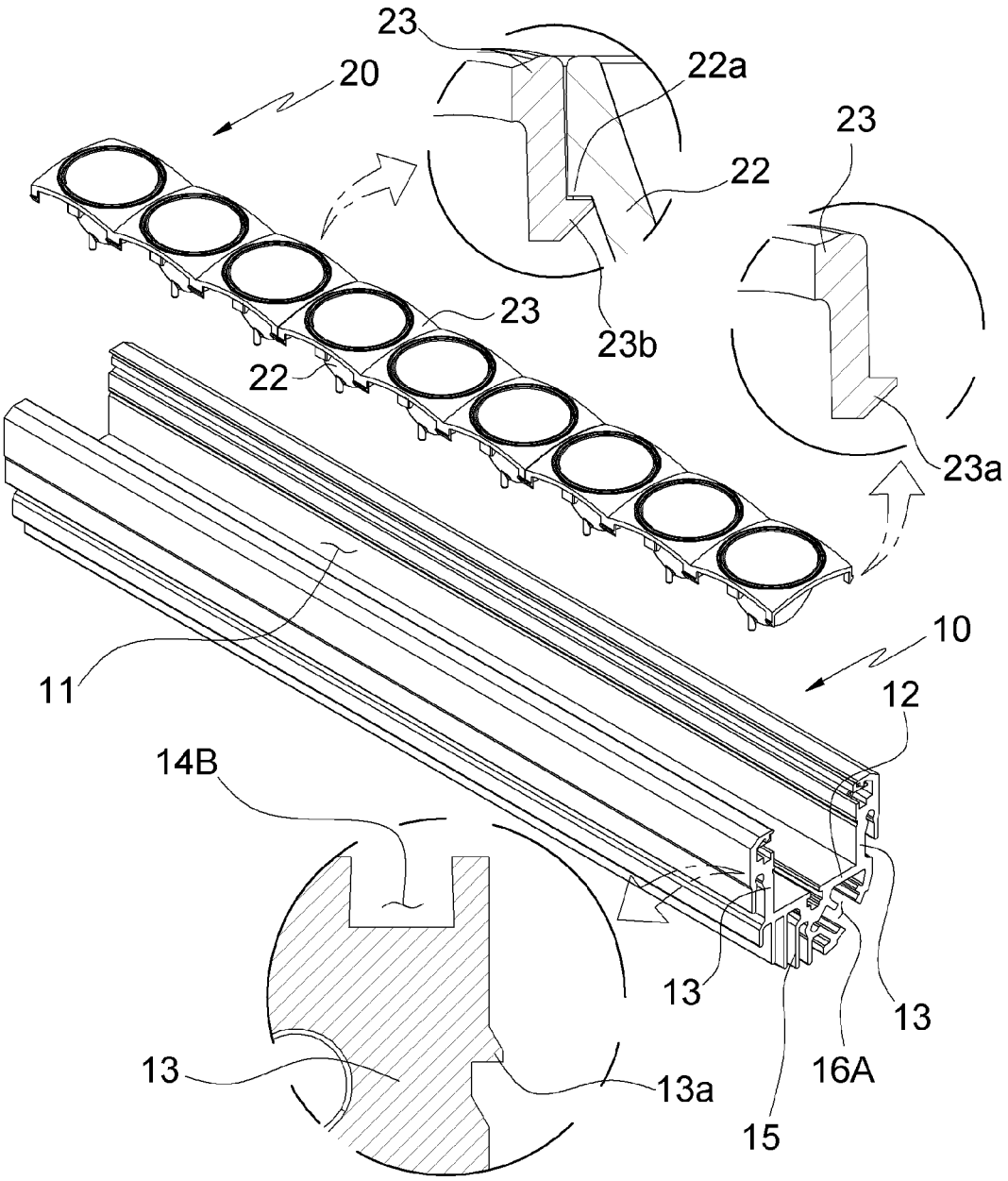
FIG. 4 is an exploded perspective view of a housing and a translucent panel according to the present invention.

The present invention will now be described in detail based on aspects (or embodiments). The present invention may, however, be embodied in many different forms and should not be construed as being limited to only the embodiments set forth herein, but should be construed as covering modifications, equivalents or alternatives falling within ideas and technical scopes of the present invention.

In the figures, like reference numerals, particularly, tens and units, or reference numerals having like tens, units and letters refer to like elements having like functions throughout, and unless the context clearly indicates otherwise, elements referred to by reference numerals of the drawings should be understood based on this standard.

Also, for convenience of understanding the elements, in the figures, sizes or thicknesses may be exaggerated to be large (or thick), may be expressed to be small (or thin), or may be simplified for clarity of illustration, but due to this, the protective scope of the present invention should not be interpreted narrowly.

The terminology used herein is for the purpose of describing particular aspects (or embodiments) only and is not intended to be limiting of the present invention. As used herein, the singular forms are intended to include the plural forms as well, unless the context clearly indicates otherwise.

It will be further understood that the terms "comprises", "comprising", "includes", and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which the present invention belongs. It will be further understood that terms used herein should be interpreted as having a meaning that is consistent with their meaning in the context of this specification and the relevant art and will not be interpreted in an idealized or overly formal sense unless expressly so defined herein.

It will be understood that, although the terms first, second, etc. may be used herein to describe various elements, these elements should not be limited by these terms.

Figure 5:
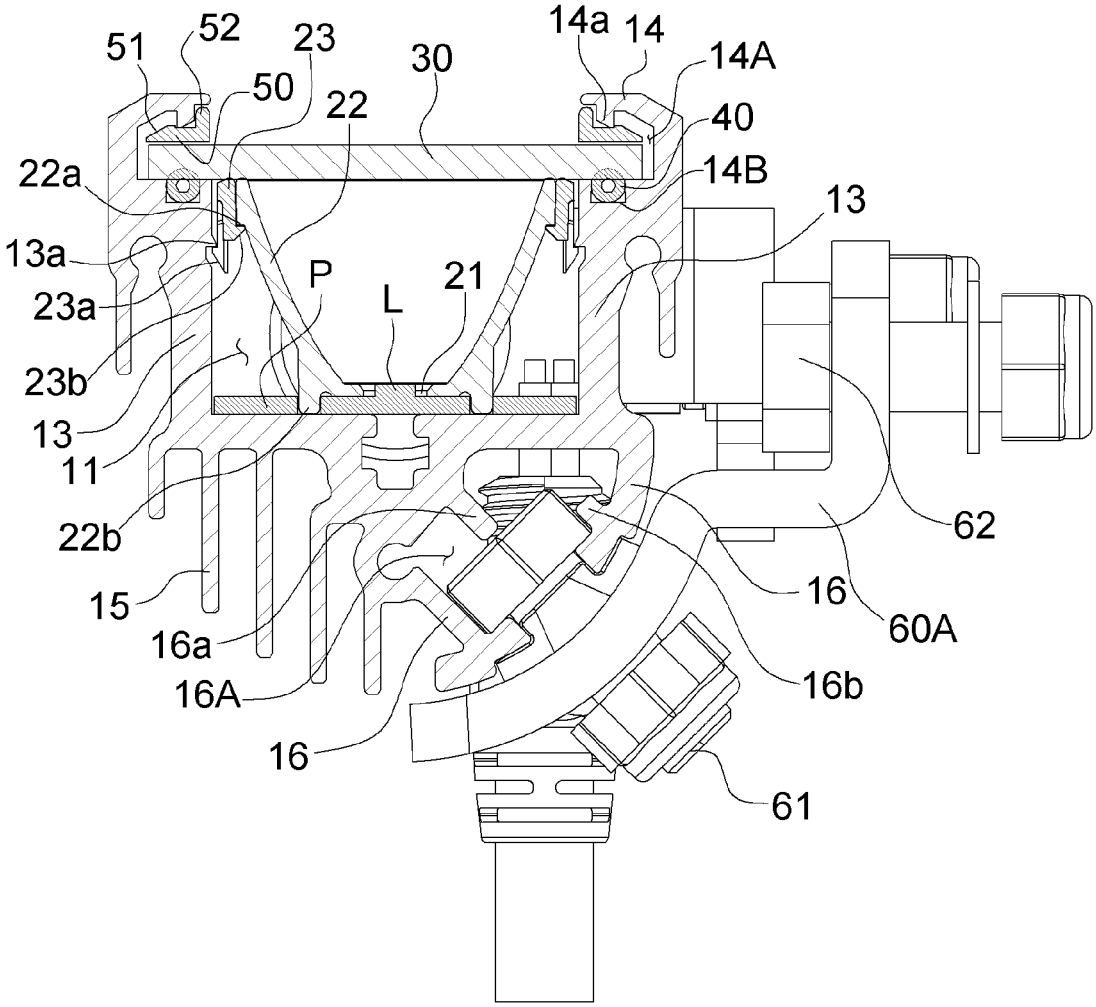
FIG. 5 is a sectional view of the lamp assembly according to the present invention.

In describing a lamp assembly according to the present invention, for the sake of convenience of description, assuming that an approximate direction reference is specified with reference to FIG. 5, the direction of gravity acting is defined as downward, and up, down, left and right are defined viewed as they are, and the top and bottom surfaces are used in combination as front and back surfaces in reference to the direction in which the light is emitted. Unless otherwise specified in the description and claims of the invention relating to the different drawings, directions are specified in accordance with this.

Hereinbelow, reference will be made in detail to lamp assembly with improved assembly convenience and waterproof performance according to the present invention, with reference to the accompanying drawings.

As shown in FIGS. 1A to 5, a lamp assembly according to the present invention roughly includes: a housing 10 mounted to an illumination facility (not shown) of a light tower or a construction vehicle; a lampshade 20 for diffusing or focusing light of a light source L; a translucent panel 30 for protecting the light source L; a packing 40 for ensuring watertightness between the housing 10 and the translucent panel 30; a press bar 50 for allowing the translucent panel 30 to be fixed and the packing 40 to be pressed simultaneously; and first and second brackets 60A and 60B for allowing the lamp assembly to be mounted.

Firstly, the housing 10, to which multiple light sources L arranged in a line to have a predetermined length are mounted, includes: a bottom portion 12 and side wall portions 13 forming a light source mount portion 11 in a longitudinal direction; a flange portion 14 being connected to each front end (upper end in the drawing) of the side wall portions 13 and forming a first insertion portion 14A with an inner side surface thereof being open; and a second insertion portion 14B provided on a bottom surface of the first insertion portion 14A.

A PCB substrate P for the light source L corresponding to the mount portion 11 is coupled to the bottom portion 12 of the mount portion 11, and the light sources L such as an LED lamp are arranged in a line on a front surface (upper surface in the drawing) of the PCB substrate P while being spaced apart from each other by predetermined intervals.

In addition, multiple heat dissipation portions 15 are provided on a rear surface of the housing 10 in the longitudinal direction, and heat dissipation wings 16 are provided at a side of the heat dissipation portions 15 for connecting a first bracket 60A.

The first insertion portion 14A is a connection portion formed in a 'ㄷ' shape with the inner side surface thereof being open with respect to the side wall portion 13, and is integrally connected with the side wall portion 13 of the housing 10, wherein a part of the opposite side ends of the translucent panel 30 and the press bars 50 are fitted in the first insertion portions 14A.

The second insertion portion 14B is provided on the bottom surface of the first insertion portion 14A and is formed in a 'ㄷ' shape with the upper surface thereof being open, wherein the packing 40 is fitted in the second insertion portion 14B.

Further, the housing 10 includes: a first stop protrusion 14*a* protruding from the inner side surface of the flange portion 14; and a second stop protrusion 13*a* protruding from the inner side surface of the side wall portion 13.

The first stop protrusion 14*a* is configured such that the rear surface thereof is inclined upwardly toward the inside, such that a first hook protrusion 51 of the press bar 50 is forcibly fitted and engaged therewith.

The second stop protrusion 13*a* is configured such that the inner side surface thereof is inclined downwardly, such that a second hook protrusion 23*a* of the lampshade 20 (more specifically, an edge portion 23 is forcibly fitted and engaged therewith.

In addition, an insertion channel 16A is formed between the heat dissipation wings 16, to which a fixing bolt 61 of the first bracket 60A is slidably coupled, wherein on the front side bottom surface of the insertion channel 16A and on the inner surface of one heat dissipation wing 16, a first support portion 16*a* and a second support portion 16*b* protrude in a diagonal direction orthogonal to each other.

The housing 10 is configured such that the lamp mount portion 11 is open at longitudinal opposite sides thereof, and a cap member 17 is fitted over each of the opening sides and fastened thereto by bolting.

The lampshade 20, which is coupled to the mount portion 11 to diffuse or focus the light emitted from the light source L of the PCB onto the front surface by reflecting the light, is a dorm-shaped member having a front opening, and a reflector or reflective coating for reflection of light may be added to the inner surface of the lampshade 20.

The lampshade 20 is forcibly fitted into the front opening of the mount portion 11 and coupled to the mount portion by hooking, and includes the second hook protrusion 23*a* protruding backwards from the front end of each of the opposite outer sides so as to be engaged with the second stop protrusion 13*a*.

In addition, as in the present invention, in a bar type lamp in which multiple light sources L are arranged in a line, the lampshade 20 should be configured such that each light source L is separately provided therein not to interfere with other light sources, and thus, the lampshade 20 is configured such that multiple body portions 22 formed in a dome shape and multiple edge portions 23 forming respective upper edges of the body portions 22 are coupled to each other in a line.

To be more specific, a receiving hole 21 is formed through the bottom surface of the body portion 22 such that the light source L is exposed through the receiving hole 21 to emit the light, and the edge portion 23 coupled to the front end of the body portion 22 is provided with the second hook protrusion 23*a* at each of the opposite sides thereof.

Here, to facilitate assembly of the body portion 22 and the edge portion 23, the body portion 22 includes a third stop protrusion 22*a* protruding from a front end of an outer side thereof, the edge portion 23 includes a third hook protrusion 23*b* protruding from a rear surface thereof to be engaged with the third stop protrusion 22*a*, and the body portion 22 and the edge portion 23 constituting the lampshade 20 are assembled to each other by being hooked to each other.

The packing 40 is a soft flexible member having a predetermined elastic force such as rubber or silicone, and a hollow type O-ring having a hollow portion 41 formed in a longitudinal direction is used as the packing.

The press bar 50, which is a member that fixes the translucent panel 30 and presses the packing 40 to ensure watertightness, is inserted in the first insertion portion 14A between the upper surface of the flange portion 14 and the translucent panel 30, and presses the translucent panel 30 and the packing 40, thereby fixing the translucent panel 30 and endowing the packing 40 with watertightness.

To be more specific, the press bar 50 is formed in an L-shape, and includes: a first hook protrusion 51 provided at an outer end of the press bar 50 to be engaged with the first stop protrusion 14*a*; and a stop step 52 being bent from an inner end of the press bar 50 and extending forwardly to be supported by the second stop protrusion 13*a*.

Further, the present invention includes: a first bracket 60A for adjusting a longitudinal position of the housing 10; and a second bracket 60B for adjusting forward and backward angle of the housing 10. Any one or all of the brackets may be used depending on the specification of the illumination facility to which the lamp assembly is mounted.

To be more specific, the first bracket 60A has a bent shape to correspond to the sectional shape of the heat dissipation wings 16 of the housing 10, and is configured such that an inner side end thereof is provided with an oblong hole 61*a* into which the fixing bolt 61 for connecting the first bracket 60A and the housing 10 together is inserted, and an outer side end thereof is provided with a fastening hole 62*a* into which a bracket-fastening mounting bolt 62 is inserted.

Accordingly, when a head of the fixing bolt 61 or a nut is slidably inserted in the insertion channel 16A, the head or the nut is supported by the first and second support portions 16*a* and 16*b* in a diagonal direction orthogonal to each other, thereby preventing the fixing bolt 61 from shaking back and forth. The fixing bolt 61 can easily adjust the left and right positions of the insertion channel 16A in the longitudinal direction so that the lamp assembly is installed using the bracket-fastening mounting bolt 62 by adjusting the intervals between the first brackets 60A according to the specifications of the illumination facility to which the lamp assembly is mounted, to be mounted.

In addition, the second bracket 60B is hinged to the outer side surface of the cap member 17 to adjust forward and backward angle of the housing 10, and includes: a hinge hole (without reference number) is provided at an inner end thereof into which an angle adjusting bolt 63 is inserted; and a fastening portion 64A extending from an outer end thereof by being bent in the longitudinal direction of the housing 10, wherein a fastening hole 64*a* is provided such that the mounting bolt 64 is inserted in the fastening portion 64A.

The second bracket 60B enables adjusting the forward and backward angle of the housing 10 by the angle adjusting bolt 63 after the illumination facility is installed using the mounting bolt 64, so it is possible to change the direction (angle) of the light emitted from the light source L.

The present invention configured as described above is assembled by the following manner: firstly, the lampshade

20 is assembled by hook-coupling through the third stop protrusion 22*a* and the third hook protrusion 23*b* of the body portion 22 and the edge portion 23; the PCB substrate P for the light source L is coupled to the housing 10 with the cap member 17 being separated therefrom; and the assembled lampshade 20 is forcibly fitted in the mount portion 11 and assembled by hook-coupling by using the second stop protrusion 13*a* and the second hook protrusion 23*a*.

Then, in the state where the packing 40 is fitted in the second insertion portion 14B, the translucent panel 30 is slidably coupled to the first insertion portion 14A, and the translucent panel 30 is elastically supported by the elasticity of the packing 40, so that a part of opposite sides of the translucent panel 30 is supported on the flange portion 14, whereby the translucent panel 30 is temporary assembled.

In this state, when the translucent panel 30 is pressed inwardly and then the press bar 50 is forcibly fitted into the gap between the flange portion 14 and the translucent panel 30, that is the first insertion portion 14A, the first hook protrusion 51 is stopped by the first stop protrusion 14*a*, so the press bar 50 is forcibly fitted into the first insertion portion 14A and fastened thereto by hook-coupling.

As such, when the press bar 50 is fastened, the first stop protrusion 14*a* is inserted between the first hook protrusion 51 and the stop step 52, so that the press bar 50 is prevented from shaking left and right and from being separated, and in this state, by the press bar 50, the translucent panel 30 is pressed backwards to press the packing 40, whereby by the pressure of the translucent panel 30, the packing 40 is compressed to seal the space of the second insertion portion 14B, and thus, the housing 10 and the translucent panel 30 are brought into close contact with each other, so watertightness between the housing 10 (more specifically, the mount portion 11) and the translucent panel 30 is secured firmly.

After assembling the translucent panel 30 using the press bar 50, when the cap member 17 is assembled to each of the longitudinal opposite sides of the housing 10 using a bolt, the entire assembly of the lamp assembly is quickly completed, and the lamp assembly has a waterproof function for protecting the light source L since the mount portion 11 having the light source L therein is sealed by the packing 40 and the cap member 17.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A lamp assembly comprising:

a housing disposed in a horizontal direction, the housing including: a bottom portion formed in a longitudinal direction of the housing, side wall portions protruding upwardly from the bottom portion, the bottom portion and the side wall portions forming a light source mount portion, a flange portion connected to an upper end portion of the side wall portions and forming a first insertion portion having a ⊏-shape opened towards the light source mounting portion, and a second insertion portion formed in a bottom surface of the ⊏-shape of the first insertion portion;

a light source disposed inside the light source mount portion;

a lampshade disposed inside the light source mount portion;

a packing fitted in the second insertion portion;

a translucent panel covering the light source mount portion and having a longitudinal edge, the longitudinal edge being inserted into the ⊏-shape of the first insertion portion and disposed on the packing fitted in the second insertion portion; and a press bar being inserted between an upper surface of the ⊏-shape of the first insertion portion and the translucent panel and pressing the translucent panel and the packing so as to provide a watertight sealing, wherein the housing further includes a first stop protrusion protruding downwards from the upper surface of the ⊏-shape of the first insertion portion of the flange portion, and the press bar includes a first hook protrusion formed on an upper surface of the press bar and configured to be engaged with the first stop protrusion.

2. The lamp assembly of claim 1, wherein the housing further includes a second stop protrusion formed on the side wall portions and protruding towards the light source mount portion, and the lampshade includes a second hook protrusion formed at an outer side thereof so as to be engaged with the second stop protrusion.

3. The lamp assembly of claim 2, wherein the lampshade further includes:

a body portion provided with a receiving hole; and an edge portion coupled to a longitudinal side portion of the body portion, and provided with the second hook protrusion, wherein the body portion includes a third stop, and the edge portion includes a third hook protrusion to be engaged with the third stop protrusion.

* * * * *